US008522922B1

(12) United States Patent
Stokes

(10) Patent No.: US 8,522,922 B1
(45) Date of Patent: Sep. 3, 2013

(54) FOLDABLE WORK PLATFORM

(76) Inventor: Patrick Stokes, Youngsville, LA (US)

( * ) Notice: Subject to any disclaimer, the term of this patent is extended or adjusted under 35 U.S.C. 154(b) by 83 days.

(21) Appl. No.: 13/161,272

(22) Filed: Jun. 15, 2011

Related U.S. Application Data

(60) Provisional application No. 61/356,733, filed on Jun. 21, 2010.

(51) Int. Cl.
*E04G 3/00* (2006.01)
*B63B 17/00* (2006.01)

(52) U.S. Cl.
USPC ..... 182/223; 114/353; 114/362

(58) Field of Classification Search
USPC ..... 182/222, 223; 114/353, 362; 14/71.1
See application file for complete search history.

(56) References Cited

U.S. PATENT DOCUMENTS

| | | | | |
|---|---|---|---|---|
| 1,394,863 | A * | 10/1921 | Reynolds | 403/113 |
| 2,121,573 | A * | 6/1938 | Robertson | 404/58 |
| 7,134,400 | B2 * | 11/2006 | Blank | 114/362 |
| 2008/0251322 | A1 * | 10/2008 | Irvin | 182/222 |
| 2010/0175608 | A1 * | 7/2010 | Heckaman et al. | 114/362 |
| 2010/0230210 | A1 * | 9/2010 | Hanks et al. | 182/113 |

* cited by examiner

*Primary Examiner* — Alvin Chin Shue

(57) ABSTRACT

A hinged, foldable work platform that may be mounted on the deck of a vessel such as lift boat or type of work boat is described. The platform has a support frame and a work deck frame pivotally mounted to each other. When not in use, the work deck frame is pivotally folded for storage upon the support frame. When the work platform is required, the vessel is positioned at a desired location and the work platform is deployed by pivoting the work deck frame from the support frame and unfolded so that the work deck frame extends from the side of the vessel to a work area away from the vessel.

10 Claims, 6 Drawing Sheets

FOLDABLE WORK PLATFORM

PRIORITY

This application claims priority to U.S. provisional application entitled "Foldable Work Platform" bearing Ser. No. 61,356,733 filed Jun. 21, 2010, the entire content of which is hereby incorporated by reference.

FIELD OF INVENTION

This invention relates to a work platform and method, more particularly, to a hinged, foldable work platform mounted to a boat deck to provide for work crew access over or to a specific location such as a vertically extending pipe stand or to a subsea wellhead that may be used in the offshore production of oil and gas and the like.

BACKGROUND OF INVENTION

Often times it is advisable or necessary to position a work boat or vessel over a predetermined location. In many such situations, underwater debris or obstructions prevent or make it difficult to accomplish such positioning due to threat of damage to the work vessel. Consequently, a need exists for a device and method to position a work platform at a desired position but that will allow a vessel to be positioned away from the work area in order to avoid or reduce the threat of damage to the vessel.

SUMMARY OF INVENTION

The present invention provides a hinged, foldable work platform that may be mounted on the deck of a vessel such as lift boat or other type of work boat. The platform has a support frame and a work deck frame pivotally mounted to each other. When not in use, the work deck frame is pivotally folded for storage upon the support frame. When the work platform is required, the vessel is positioned at a desired location and the work platform is deployed by pivoting the work deck frame from the support frame and unfolded so that the work deck frame is cantilevered from the support frame and extends from the side of the vessel to a work area away from the vessel.

The work platform has a main support frame having at least a pair of support beams and a work platform support frame having at least a pair of support beams. The main support frame is mounted to a vessel as shown in FIG. 1. The work platform support frame is pivotally mounted to the main support frame. The main support frame and the work platform support frame are configured with floor braces to support a floor or work deck to provide a work deck area for workers. The work deck area has a flooring system which may be comprised of checkered plate decking, bar grating, a combination of checkered plate decking and bar grating, or other suitable flooring systems.

The work deck area of the work platform support frame may have a plurality of work deck platform extensions have plug and socket connections to allow for the detachable mounting of the work deck extensions to the work platform support frame. Detachably mounted handrail sections are provided around the work deck area of the work platform support frame. Similarly, attachable and detachable handrail sections may be mounted around the walkway deck surfaces and the main work deck area by means of sockets on the support frames.

The work deck area of the work platform frame may have an opening to provide access to areas below the work platform such as to a well bore are the piping and valve superstructure of a well bore. The work deck area may be configured with a variety of openings as may be desired such as a slot opening to allow installation around a vertical work piece such as pipe or a rectangular deck opening to provide a means to drop equipment through the work deck area. The openings in the work deck area may be covered with flooring such as checkered plate decking or bar grating when access through the work deck is not required.

The work platform is provided with a hinge assembly or other means for pivoting the work platform frame with respect to the main support frame in order to extend the work platform frame away from the vessel to a desired position. This will allow the pivotally attached work platform frame and any attached work deck to be cantilevered from and supported by the main support frame in a desired position.

DESCRIPTION OF EMBODIMENT

Figure 1:
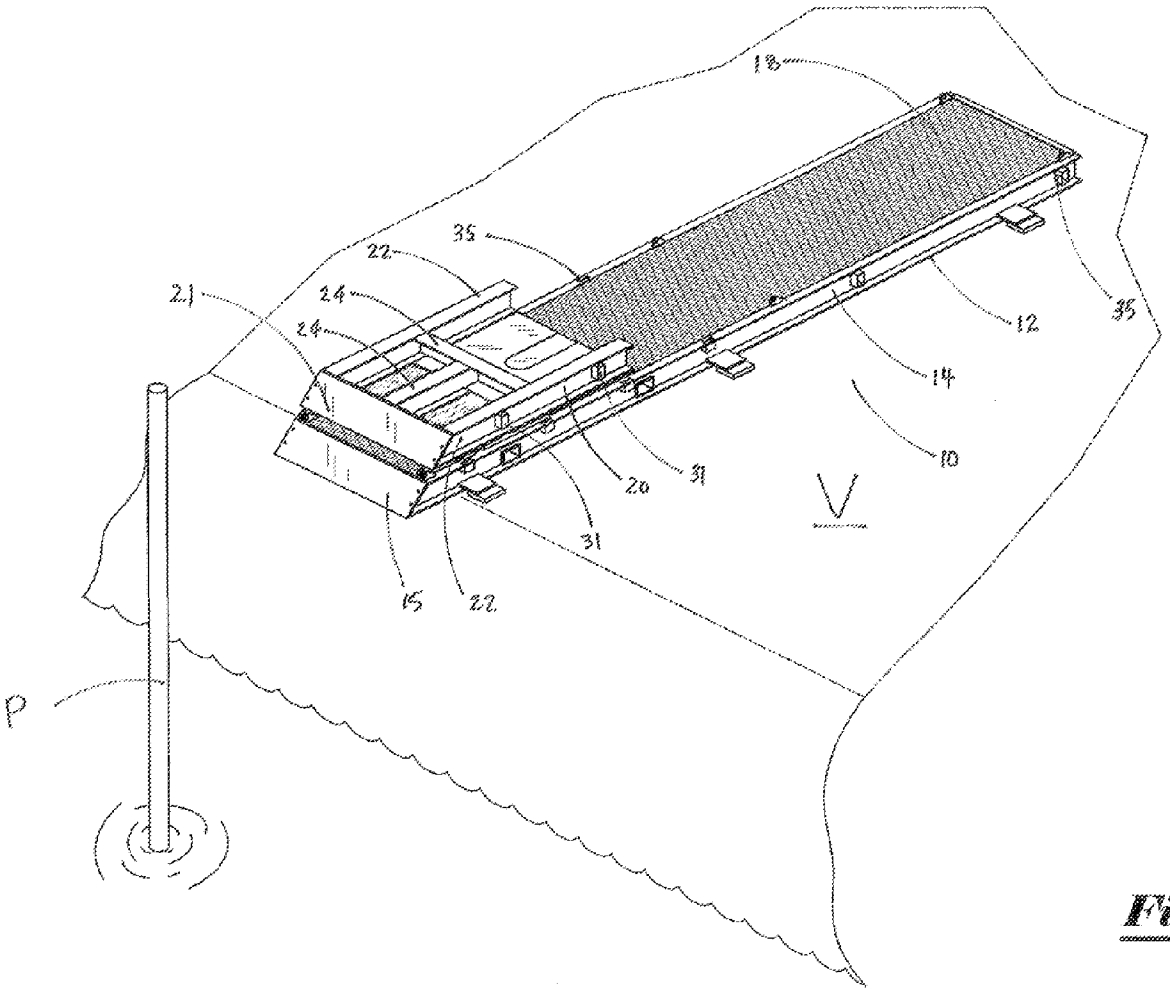
FIG. 1 is a perspective view of the foldable work platform of the present invention mounted on a work vessel.
Figure 2:
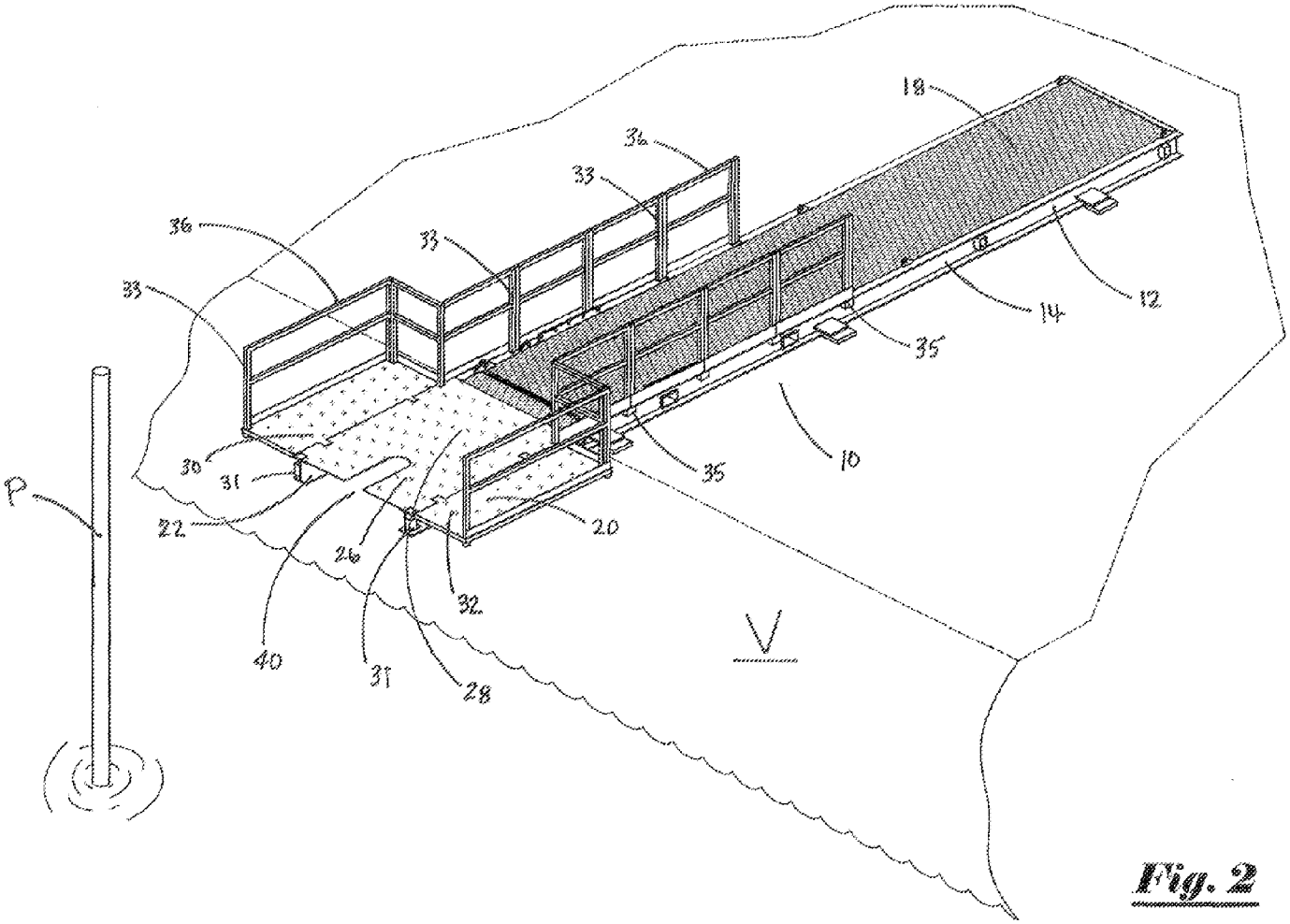
FIG. 2 is a perspective view of the foldable work platform of FIG. 1 being positioned at a work location.

FIG. 1 and FIG. 2 show a perspective view of the foldable work platform (10) mounted on the deck of a vessel (V) such as lift boat or work boat. FIG. 1 shows the platform (10) in its folded position prior to deployment from vessel (V), FIG. 2 shows the platform (10 in its extended position after deployment from vessel (V).

As shown in the drawings, the platform (10) is comprised of a longitudinally extending support frame (12) having at least a pair of longitudinally extending support beams (14) that support a deck surface (18). The support beams (14) terminate at one end at a diagonally slanted termination plate (15). The support frame (12) is attached to the deck of vessel (V) by welding, bolting, or other attachment means.

Figure 4A:
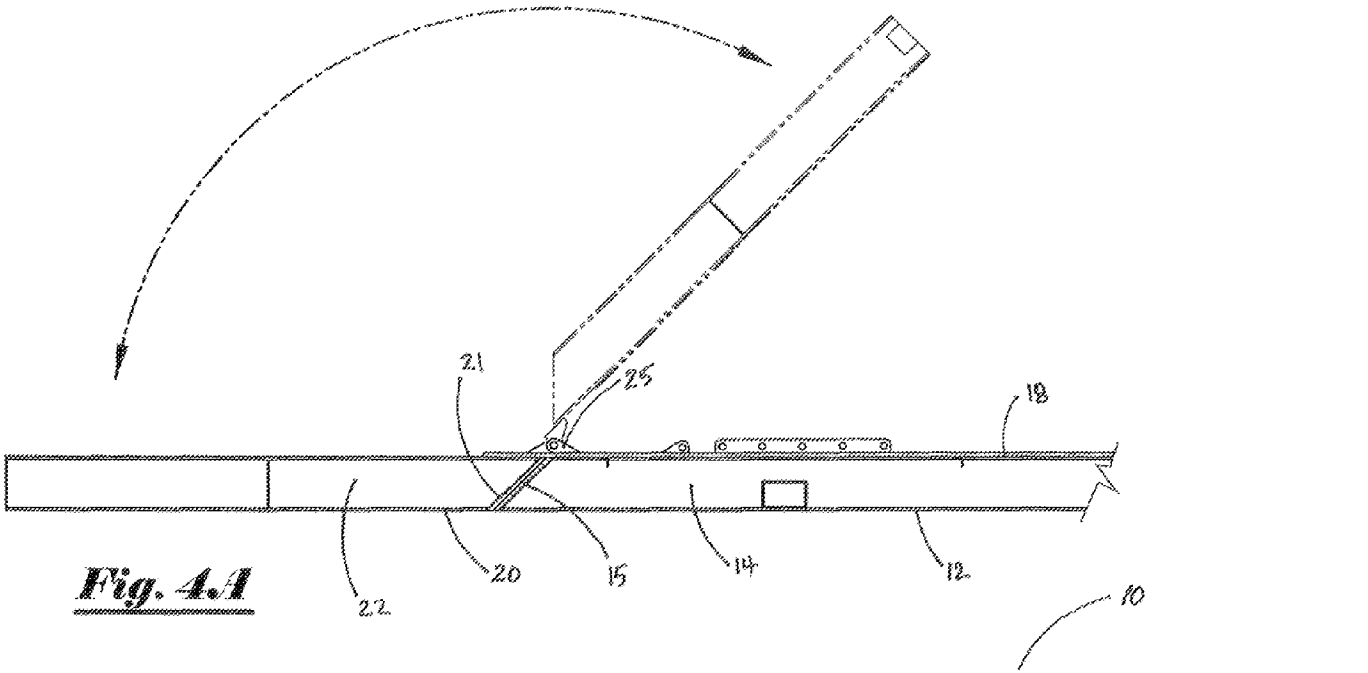
FIGS. 4A and 4B are longitudinal cross-section views of the work platform showing the pivotal extension of the work platform.
Figure 4B:
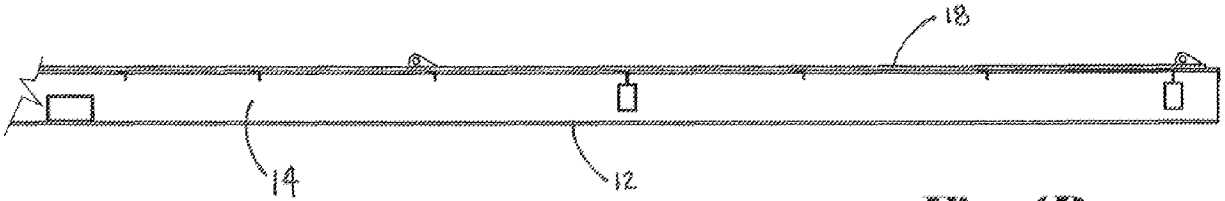
Figure 7:
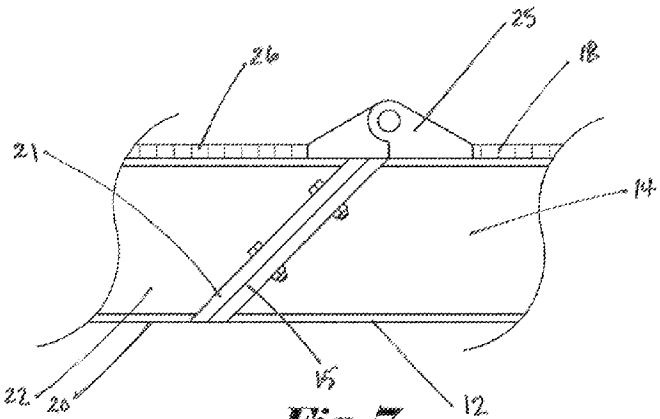
FIG. 7 is a side elevation view of a hinge mechanism for pivoting the platform.

The support beams (14) of the support frame (12) are configured and positioned to hold and support a pivotally mounted work platform support frame (20). The work platform frame (20) is comprised of floor support beams (22) with framing braces (24) that support a work deck surface (26) in order to create a work deck area (28). The support beams (22) of the work platform support frame (20) terminate at one end at a diagonally slanted termination plate (21). The termination plate (21) of the work platform support frame (20) corresponds with the slanted termination plate (15) on the support frame (12). As shown in FIG. 1, FIGS. 4A and 4B and in detail in FIG. 7, the support beams (22) are pivotally mounted to the support beams (14) of the support frame (12) at termination plates (15) and (21) by means of a hinge assembly (25).

The hinge assembly (25) is mounted to termination plates (15) and (21) whereby the work platform frame (20) may be pivoted onto the support frame (12) and whereby the work platform frame (20) may be pivoted outward from the support frame (12) so that the work platform frame (20) cantilevered from and supported by the support frame (12) by means of the corresponding termination plates (15) and (21) and the hinge assembly (25). When supported in such a manner, the work platform support frame (20) will extend outward from the end of the support frame (12) and away from the deck of the vessel (V). The corresponding diagonally slated termination plates (15) and (21) allow the deck surface (18) and work deck surface (26) to align when the work platform frame (20) extends outward from the end of the support frame (12).

As shown in FIG. 1 and FIG. 2, the deck surface (18) and work deck surface (26) may be checked plate decking, bar grating, or a combination of bar grating and checkered plate decking, or any other suitable flooring system.

Figure 3:
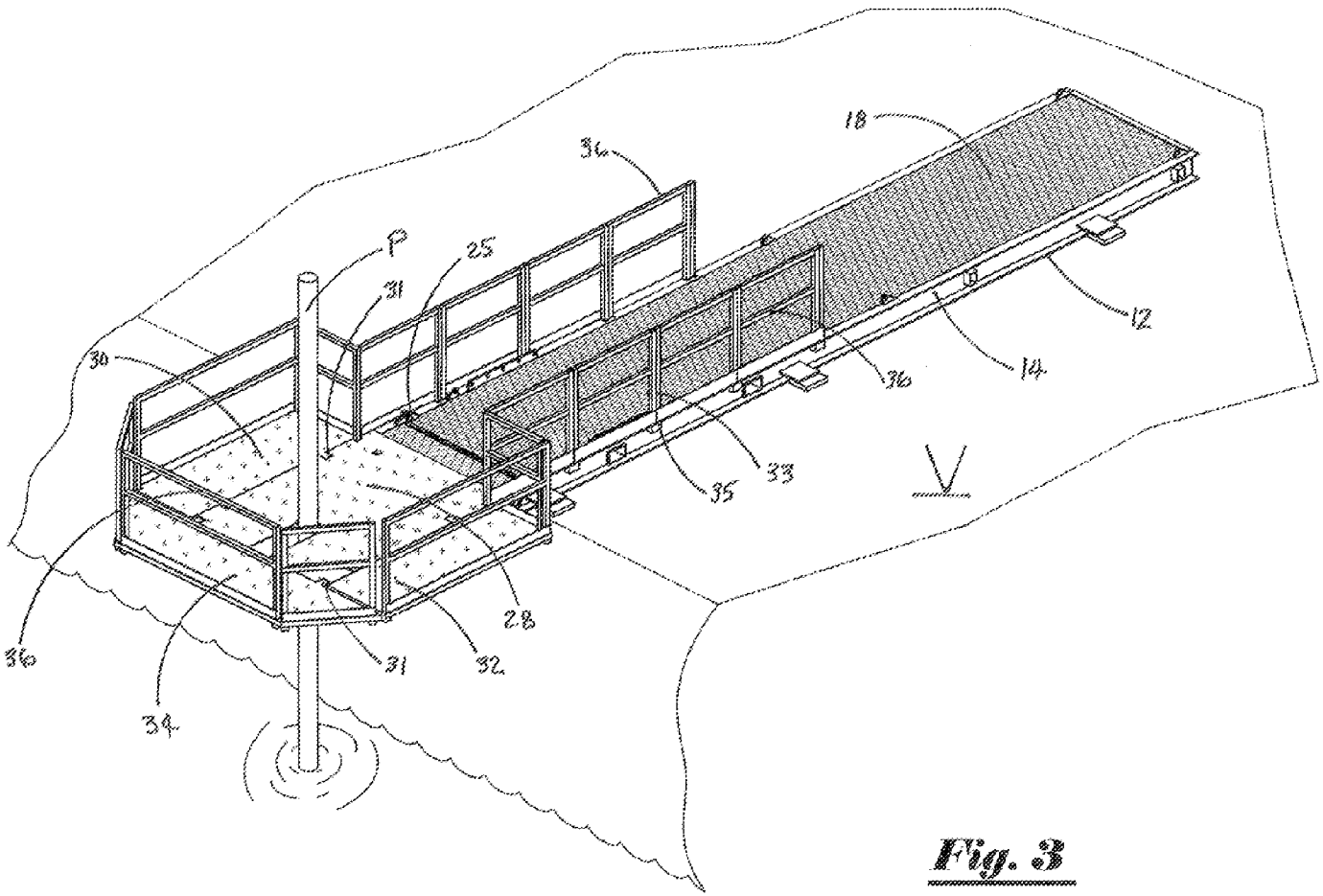
FIG. 3 is a perspective view of the foldable work platform of FIG. 1, and configured with work deck extensions and handrail sections, in place at a work location.
Figure 5A:
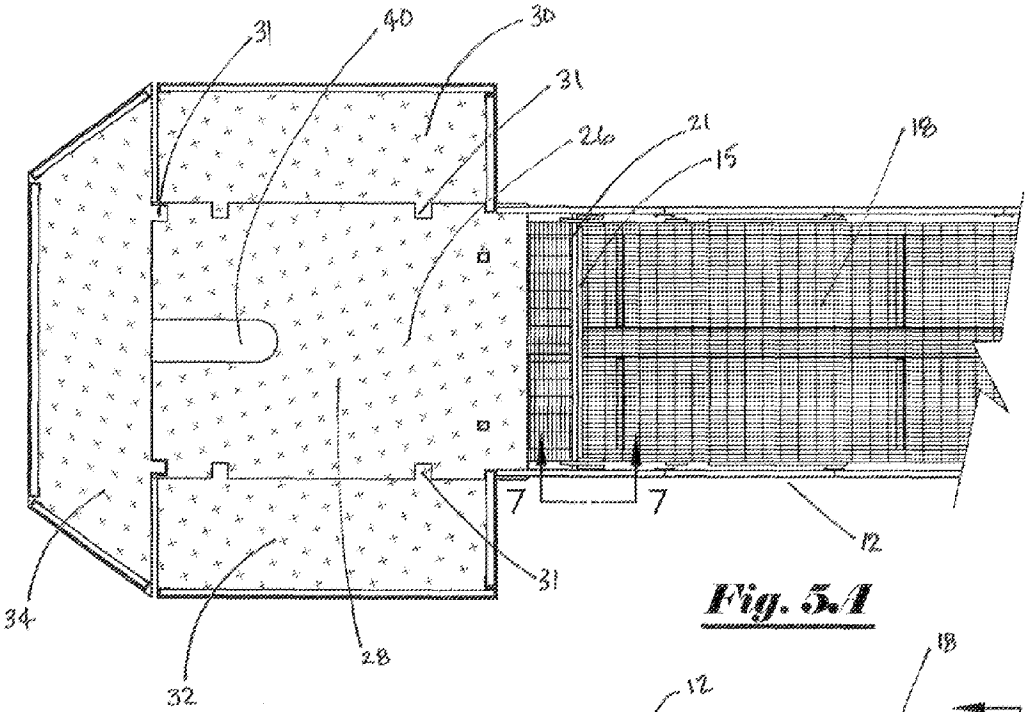
FIGS. 5A and 5B are top views of the work platform of FIG. 1 with the work deck in an extended and fully deployed position.
Figure 5B:
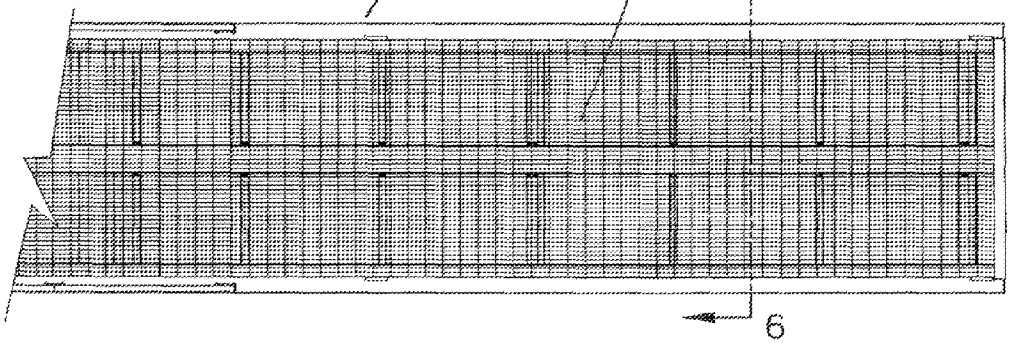

As shown in FIGS. 3, 5A and 5B, the main work deck area (28) may be expanded by the use of attachable and detachable work deck extensions (30), (32) and (34) of a desired shape. Plugs mounted to the work deck extensions (30), (32) and (34) mate with sockets mounted to the work platform frame (20) creating plug and socket connections (31) to allow for the attachable and detachable mounting of the work deck extensions (30, 32, 34) to expand the main work deck area (28).

Figure 6:
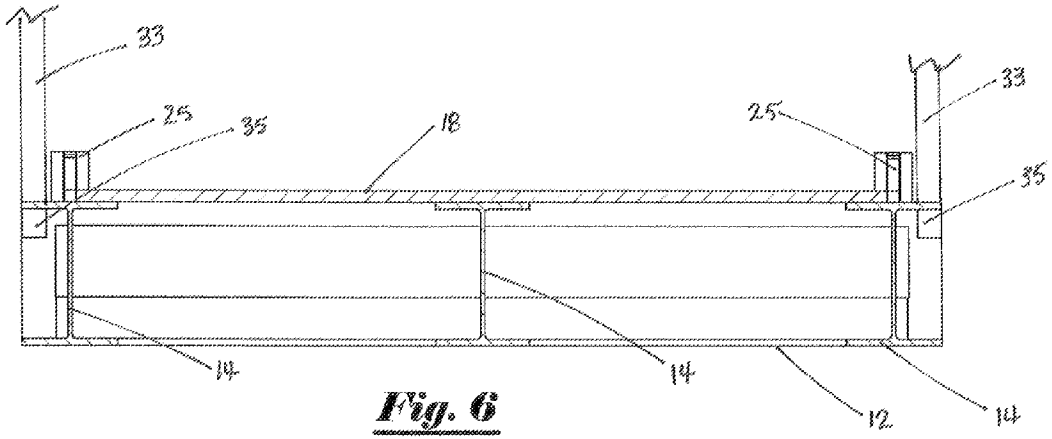
FIG. 6 is a transverse cross-section view of the work platform shown in FIG. 5B showing the support beams, work deck, and handrail and socket configuration.

As shown in FIGS. 2 and 3 and FIG. 6, a plug and socket connections (31) on the work platform frame (20) allow for the detachable mounting of the work deck extensions (30, 32, 34). Similarly, attachable and detachable handrail sections (36) having handrail a plurality of handrail posts (33) may be mounted around the deck surfaces (18) and (26) and the main work deck area (28) by insertion of a handrail post (33) into a corresponding socket (35) mounted on the support frames (12) and (22) and the work deck extensions (30, 32, 34). The sockets (35) may be configured to match with the plug and socket connections (31) in order to allow handrail sections to be installed when work deck extensions (30, 32, 34) are not employed.

The use of the attachable and detachable work deck extensions (30, 32, 34) allow the work deck area (28) to be configured as may be needed. For example, the work deck extensions (30, 32, 34) allow the work deck area (28) to be configured to provide the deck area (28) with a variety of desired openings such as the slot opening (40) shown in FIG. 5A. The attachable and detachable work deck extensions (30, 32, 34) to allow the deck area (28) to be extended around a vertical work piece such as pipe (P) that is located a distance away from the vessel V as shown in FIG. 3.

In use, as shown in FIGS. 1 and 2, the work platform (10) is mounted to a vessel (V) such as a work boat, lift boat, or barge. The vessel (V) is then moved into a desired location with respect to a work area or work piece (P). The vessel (V) is then anchored or otherwise held in the desired location with respect to the work piece (P).

After the vessel (V) is held in the desired position, the work platform support frame (20), with the associated walkway deck surface (26), is pivoted from its folded position with respect to the support frame (12) to its extended position, as shown in FIGS. 4A and 4B, and cantilevered from the support frame (12) and from the vessel (V) toward the work area or work piece. The main work deck area (28) may then be expanded by the addition of the detachable work deck extensions (30, 32 and 34) by means of plug and socket connections (31). This allows the main work deck area (28) to be tailored as needed such as by providing an opening (40) to receive a pipe (P) through the work deck area (28).

Detachable handrail sections (36) may then be mounted around the work deck (18) and the main work deck area (28) by mating the handrail posts (33) with sockets (35) on the support frames (12), the work platform frame (20), and work deck extensions (30, 32 and 34) as desired as a safety measure. When desired, the platform (10) may be relocated by removing the handrail sections (36) and the work deck extensions (30, 32, 34) and then pivoting the work platform support frame (20), with the associated walkway deck surfaces (18), onto the support frame (12). In this matter the work platform (10) may be stored or folded over until further deployment is necessary.

It is thought that the work platform and the method of the present invention and many of its attendant advantages will be understood from the foregoing description. It is also thought that one may make various changes in the form, construction and arrangement of the parts of the cable protector apparatus and system without sacrificing its material advantages or departing from the spirit and scope of the invention and that the form described herein is merely an exemplary embodiment of the invention.

I claim:

1. A vessel mounted work platform comprising:

(a) a longitudinally extending support frame, said first support frame having at least a pair of longitudinally extending support beams, said support beams mounted to a deck of a vessel;

(b) a longitudinally extending work platform frame, said work platform frame having at least a pair of longitudinally extending platform support beams;

(c) a hinge assembly, said hinge assembly mounted to said support frame and to said work platform frame whereby said work platform frame may be pivoted onto and supported by said support frame and whereby said work platform frame may be pivoted outward from and supported solely by said support frame when said work platform frame is extended from said vessel;

(d) a first diagonally slanted first termination plate mounted to said longitudinally extending support beams of said longitudinally extending support frame; and (e) a second diagonally slanted termination plate mounted to said longitudinally extending support beams of said work platform frame, said second diagonally slanted termination plate corresponding with said first slanted termination plate of said support frame, whereby said second diagonally slated termination plate of said work platform frame is cantilevered from and supported upon said first diagonally slanted first termination plate when said work platform frame is pivoted to extend outward from the end of said support frame.

2. The vessel mounted work platform as recited in claim 1, further comprising:

(a) a deck surface mounted to said first longitudinally extending support frame; and (b) a deck surface mounted to said work platform frame.

3. The vessel mounted work platform of claim 2 further comprising a plurality of attachable and detachable deck extensions, said attachable and detachable deck extensions being selectively mountable to said work platform frame.

4. The vessel mounted work platform in claim 3 wherein said attachable and detachable deck extensions are attachable and detachable on said work platform frame by means of plug and socket connections.

5. The vessel mounted work platform of claim 4 further comprising a plurality of attachable and detachable handrail sections, said attachable and detachable handrail sections being selectively mountable around said support frame and said work platform frame.

6. The vessel mounted work platform in claim 5 wherein said plurality of detachable handrail sections have a plurality of handrail posts, said handrail posts being mounted to corresponding sockets mounted on said longitudinally extending support frame and said work platform frame.

7. The vessel mounted work platform as recited in claim 3 wherein said deck of said work platform frame is provided with deck sections to create an opening of a desired configuration.

8. A vessel mounted work platform comprising:

(a) a longitudinally extending support frame, said first support frame having at least a pair of longitudinally extending support beams, said support beams mounted to a deck of a vessel;

(b) a longitudinally extending work platform frame, said work platform frame having at least a pair of longitudinally extending platform support beams;

(c) a hinge assembly, said hinge assembly mounted to said support frame and to said work platform frame whereby said work platform frame may be pivoted onto and supported by said support frame and whereby said work platform frame may be pivoted outward from said support frame;

(d) a first diagonally slanted first termination plate mounted to said longitudinally extending support beams of said longitudinally extending support frame; and (e) a second diagonally slanted termination plate mounted to said longitudinally extending support beams of said work platform frame, said second diagonally slanted frame, whereby said second diagonally slated termination plate of said work platform frame is cantilevered from and supported upon said first diagonally slanted first termination late when said work platform frame is pivoted to extend outward from the end of said support frame.

9. The vessel mounted work platform as recited in claim 8, further comprising:

(a) a deck surface mounted to said first longitudinally extending support frame; and (b) a deck surface mounted to said work platform frame;

(c) a plurality of attachable and detachable deck extensions, whereby said attachable and detachable deck extensions may be selected to being selectively mountable to said work platform frame whereby the combination of said work platform frame and said attachable and detachable deck extensions may be tailored as desired.

10. The vessel mounted work platform as recited on claim 9, wherein the combination of said work platform frame and said attachable and detachable deck extensions is tailored to provide opening whereby said work platform frame may be extended around a vertically oriented work piece.

* * * * *